US005168583A

United States Patent [19]

Wanke

[11] Patent Number: 5,168,583

[45] Date of Patent: Dec. 8, 1992

[54] HANDICAPPED PERSONS' HYGIENE SEAT

[76] Inventor: Kurt R. B. Wanke, Am Weinberg 31, 8700 Würzburg 25, Fed. Rep. of Germany

[21] Appl. No.: 377,850

[22] PCT Filed: Nov. 4, 1987

[86] PCT No.: PCT/DE88/00681

§ 371 Date: Jun. 28, 1989

§ 102(e) Date: Jun. 28, 1989

[87] PCT Pub. No.: WO89/04134

PCT Pub. Date: May 18, 1989

[30] Foreign Application Priority Data

Nov. 10, 1987 [DE] Fed. Rep. of Germany ... 8714961[U]

[51] Int. Cl.[5] ..... A47K 3/03; A47K 3/12; A47K 3/22

[52] U.S. Cl. ..... 4/444; 4/554; 4/579

[58] Field of Search ..... 4/444, 480, 546, 559, 4/562, 566, 578, 579, 235, 239, 479, 483, 485, 560, 571, 572, 573, 553, 554, 254, 237, 443, 447, 445, 456, 457

[56] References Cited

U.S. PATENT DOCUMENTS

| | | | |
|---|---|---|---|
| 663,826 | 12/1900 | Baker | 4/447 |
| 906,992 | 12/1908 | Bailey | 4/554 |
| 919,848 | 4/1909 | Gilmore | 4/643 X |
| 982,626 | 1/1911 | Netschert | 4/579 |
| 1,103,516 | 7/1914 | Joy et al. | 4/579 |
| 1,406,779 | 2/1922 | Thibadore | 4/579 |
| 1,428,627 | 9/1922 | Grabfelder | 4/483 X |
| 1,691,620 | 10/1928 | Wilson | 4/480 |
| 2,588,562 | 3/1952 | Parish | 4/579 |
| 2,852,785 | 9/1958 | Mikola | 4/579 |
| 3,252,167 | 5/1966 | Eddy | 4/578 |
| 4,253,203 | 3/1981 | Thomas | 4/559 |
| 4,296,506 | 10/1981 | Stoute, Sr. et al. | 4/480 |
| 4,391,006 | 7/1983 | Smith | 4/559 |
| 4,475,256 | 10/1984 | Hatala | 4/562 |
| 4,795,214 | 1/1989 | Holdt | 4/237 X |

FOREIGN PATENT DOCUMENTS

| | | | |
|---|---|---|---|
| 458603 | 4/1928 | Fed. Rep. of Germany | 4/553 |
| 2741074 | 5/1974 | Fed. Rep. of Germany | 4/480 |
| 382400 | 11/1964 | Switzerland | 4/579 |
| 11002 | of 1906 | United Kingdom | 4/554 |
| 1600875 | 10/1981 | United Kingdom | 4/579 |
| 2144629 | 3/1985 | United Kingdom | 4/578 |

*Primary Examiner*—Henry J. Recla
*Assistant Examiner*—Robert M. Fetsuga
*Attorney, Agent, or Firm*—Edwin D. Schindler

[57] ABSTRACT

For handicapped persons, especially wheelchair users, a hygiene seat is proposed having a rim comprising two cooperating tubes (7, 8) adjustable in an axial direction and via a detent mechanism, as well as guide rails (4*a*, 4*b*) serving to receive a tub (6) or a board, whereby a cushion may be mounted on said board (3) closing the opening in the rim.

10 Claims, 1 Drawing Sheet

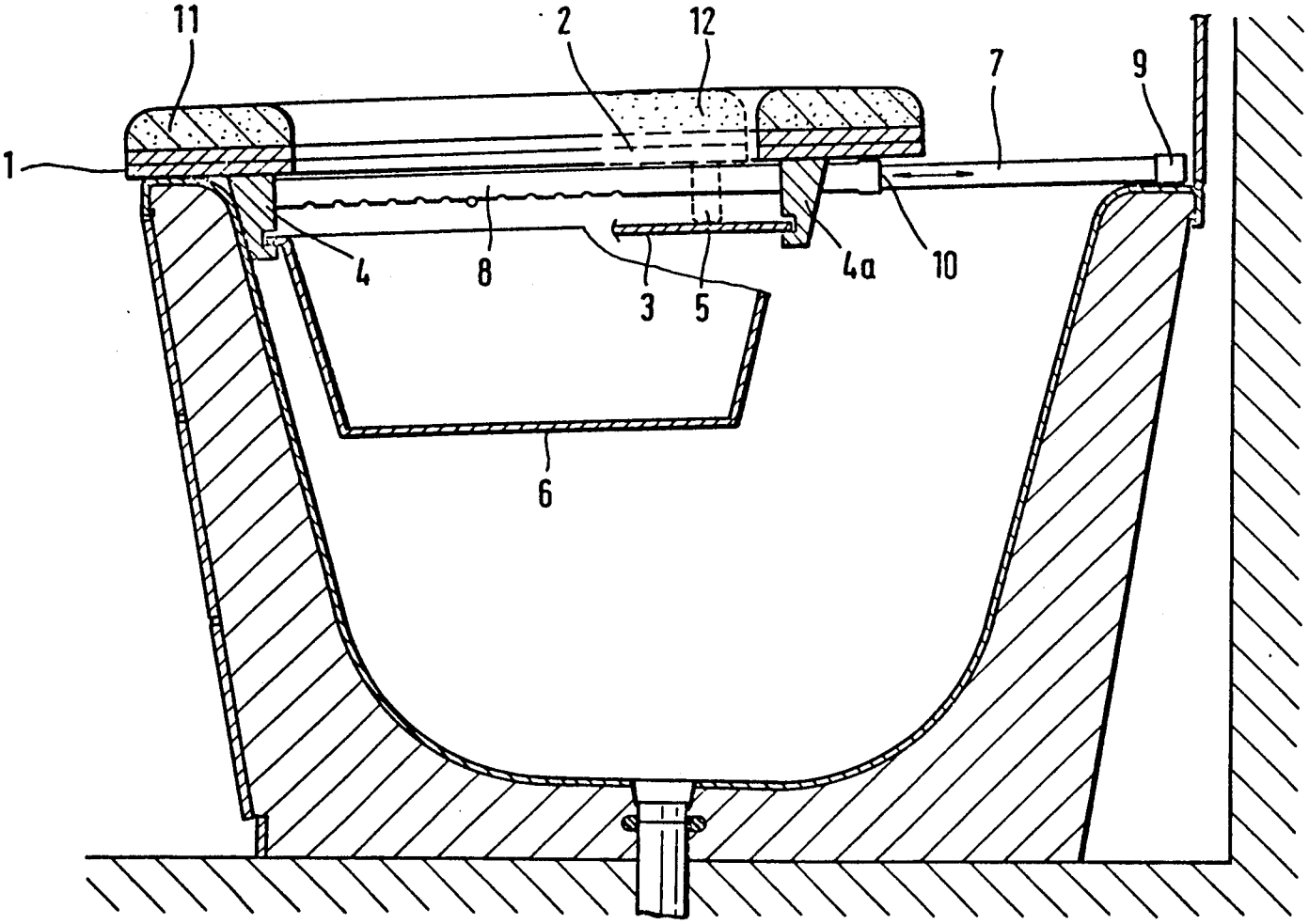
9
7
10
4a
12
5
3
2
6
8
4
11
1

HANDICAPPED PERSONS' HYGIENE SEAT

The invention concerns a hygiene seat for handicapped persons, especially wheelchair users, having a preferably upholstered rim.

With medical advances, the number of persons left in a paralyzed condition and dependent upon use of a wheelchair for mobility after surviving accidents or similar illnesses is growing. In practice considerable difficulties result when the wheelchair user is travelling, since he is dependent upon hotels for providing the requisite accommodations which include WC's designed for wheelchair use, with corresponding supports and handles, adequate door widths and adequate space in order to allow for him to maneuver the wheelchair. Similar requirements exist for washrooms and showers, which also require structural measures and the employment of a correspondingly equipped sanitary-room wheelchair. Since hotel accommodations with special facilities for handicapped persons are naturally rare, and correspondingly expensive to use, even those wheelchair users who want to travel are prevented.

Travel is difficult because of the predictable hygienic disadvantages encountered, as well as finding the required accommodations with facilities for handicapped persons.

On this basis it is the object of this invention to provide a hygiene seat for handicapped persons that makes it possible to use hotel accommodation that are not provided with wheelchair facilities.

This object is solved by providing an apparatus having two cooperating, axially displaceable tubes which have a detent mechanism, as well as guide rails, which are disposed on the underside of the rim, in the edge area, which serve to receive a tub or board, whereby a cushion closing the opening of said rim may be laid on said board.

The crucial advantage of the present invention is that a hotel's bathing accommodations are usable by wheelchair users with the aid of the present invention if a bathtub is available and the bathroom has an entrance door of sufficient width to permit access by the wheelchair. One of the basic features of the present invention provides that by laying the hygiene seat on the top edge of a standard bathtub said hygiene seat is supported and fixed at a height that the wheelchair user can traverse without difficulty. The hygiene seat of the present invention may be adapted to any bathtub facility and may be used in the manner described in detail below.

For use as a shower seat the hygiene seat is laid on the top edge of a bathtub whereby first, the tubes are extended until the hygiene seat can be placed with one of its front edges on the front edge of the tub and can be laid by means of the extended tubes on the opposite edge, and is thereby supported. A cushion is inserted in the opening of the rim 50 that one of the boards serving as a support is inserted into the guide rails. The user sits upright on the seat, whereby his legs may be either in front of, or in, the tub. The latter case has the advantage that thorough washing or showering of the legs and feet is readily possible without any additional measures such as the use of a foot-bath. The handicapped person sits unrestricted, and therefore readily accessible by a nurse, which is preferable to conventional shower cabins. The washing water runs into the tub, and thence directly to the drain. Flooding of the bathroom is largely impossible.

Disabled persons necessarily sit most of the day in a wheelchair, which means that they are compelled to take the utmost care for cleanliness and hygiene of the anal/genital region, since they would otherwise quickly be afflicted with seat sores. The hygiene seat of this invention permits the use of a shower from below for thorough cleaning of these regions of the body. First the center part of the seat is removed so that only the open rim remains. The user then seats himself thereupon, the position of his legs being in principle free and they may especially be in front of the tub so that his back is oriented towards the wall. The shower head is adjusted such that the anal/genital region is sprayed. In an advantageous manner a shower holder may be used for temporary reception and fixing of the shower head. By the adjustment of the shower head as a "soft jet" in a manner known to the art, splashing of the water is reduced which, in turn, reduces the chances that flooding of the washroom facilities would occur. Because of the opening in the seat, cleaning can be done from above, as well as from below, from either the left or right side.

Another important possibility of the use according to this invention consists in the utilization as a lavatory seat. For this purpose, with open rim, a tub is inserted into the guide rail into which is introduced either an insert for dry evacuation, which is later disposable via a hygiene bag without odor, or a water filling, which serves for neutralizing odors and easy disposal by the normal WC flush.

A combination with the above-described under-shower use can thereby be accomplished by opening and adjusting the shower head for temperature and fixing it under the seat before the start of the evacuation in the manner that after removal of the tub spraying occurs upon the regions that need cleaning.

Another possible use includes using the tub as a bidet by filling it with wash water, lotion, or similar and subsequently inserting the tub under the seat. Careful washing and care is thereby additionally aided. The essential advantage of the hygiene seat according to this invention is that it makes the wheelchair user independent of reliance upon hotel/motel operators for providing wheelchair facilities, and aids him in travelling in a decisive manner. A further advantage is its universal applicability and use.

The axially adjustable tubes of the invention are lockable by a detent mechanism, which allows For the adjustable tubes to be freely positioned for any bathtub. reasons of simplicity of construction and direct positioning of the rim on the front edge of the bathtub it is sufficient and rational to design the tubes extensible in only one direction.

The possibility of adjustment of the tubes in the axial direction can be provided by a telescopic type of fastening, i.e. by more or less deep insertion into a guide tube.

Since the tubes are disposed below the rim, and the rim itself rests directly on the front edge of the bathtub, whereby the outer edge of the tubes comes to lie on the back edge of the bathtub, the rim will assume in the simplest case a position inclined to the horizontal. To remove this disadvantage, the tube is correspondingly angled outside the rim, so that the rear end is correspondingly lowered, and as a result the rim is aligned in the horizontal.

The invention also claims, in addition to the device, its use. With the aid of the above details the use of the device, by laying it in a lateral direction on the bathtub, can also be deduced.

It is additionally critical for the usability of the invention that the hygiene seat can be used independently of a bathtub if it is placed on a suitably dimensioned frame. In a dismounted condition it can be easily stowed, transported and carried in a suitcase and used and employed anywhere, as required. On account of the lack of a shower connection, the possible uses as a shower and/or undershower are in this case eliminated.

For reasons of stability, the frame has outwardly tilted legs which are connected in pairs at their top regions via struts inclined to the horizontal. At least the upper parts of each strut serve as stop surfaces for the hygiene seat, and the lower parts as guides for the shower with its hose connection.

Further details, features and advantages of the invention can be taken from the following description part in which the invention is explained in greater detail with the aid of a drawing of a typical embodiment. It shows in schematic cross-sectional view a device according to this invention in the state of being mounted upon a bath tub.

The illustrated hygiene seat comprises a base plate (2) for the rim (1) in which a cushion is inserted over the base plate (2) in the interior opening. Fastening is by means of a board (3) below this, which is retained at the sides in guide rails (4), and can be removed horizontally. The base plate (2) of the cushion rests on distance pieces (5) on the board (3).

Board (3) can be slidably removed in a horizontal direction from the guide rails (4*a*, 4) and replaced by a tub or channel (6) for washing. In the drawing figure, for convenience, incomplete illustrations of a tub or channel (6), the board and the cushion are provided. In this regard, it is to be understood that those proportions of the foregoing features not shown in the drawing have a structure which is similar to those portions so illustrated.

The hygiene seat of this invention is mounted on the front edge of the bathtub together with the front part of the base plate (2), and is thereby supported against forwards horizontal displacement by the guide rails (4). On the rear edge of the bathtub the hygiene seat rests on a support tube (7), which is telescopically adjustable in an axial direction in a guide tube (8). The outer end of the support tube (7) has a cap (9), serving to stabilize against slipping. The end of guide tube (8) is designated by reference numeral (10). In a preferred embodiment, one of the foregoing tubes is angled outside of the rim of the hygiene seat. Rails (4, 4*a*) are attached to the underside of base plate (2) of rim (1). As shown in the drawing figure, tube (8) is retained by rails (4, 4*a*), with rail (4*a*), again referring to the drawing, being attached to tube (8) at a point along the length of tube (8).

The top side of the base plate of the rim (1) is upholstered (11) and the cushion is likewise upholstered (12). The hygiene seat of the invention is able to tilt when a user mounts the seat. Because rim (1) partially rests on a side wall of the bathtub, as shown in the far left portion of the drawing figure, it is able to stabilize the seat once the user has fully mounted the seat.

As a result the device of this invention aids handicapped persons, especially wheelchair users, in performing hygienic functions without the necessity for special facilities for the handicapped.

I claim:

1. A hygiene seat for a handicapped person, comprising:

a annular seat member with an underside and capable of supporting a person in a seated position, said seat member being capable of resting on at least one side wall of a bathtub for supporting the person in the seated position;

two cooperating tubes being fixed at the underside of said seat member with one of said cooperating tubes being retained at opposing sides of said seat member, said cooperating tubes being adjustable relative to one another in an axial direction and having a detent mechanism for fixing said cooperating tubes in position;

a pair of guide rails affixed to the underside of said seat member and each at a respective one of said opposing sides, said guide rails retaining said one cooperating tube of said two cooperating tubes in position along a length of said one cooperating tube, said guide rails further including two horizontally-opposed indentations; and, a washing tub, said washing tub being slidably removable from, and held at its edges by, the two horizontally-opposed indentations of said guide rails in a horizontal direction.

2. The hygiene seat for a handicapped person according to claim 1, further comprising a cushion resting on a board, said board being received by said guide rails when said tub is removed therefrom.

3. The hygiene seat for a handicapped person according to claim 1, wherein said cooperating tubes are telescopically adjustable relative to one another.

4. The hygiene seat for a handicapped person according to claim 1, wherein said seat member is upholstered.

5. A hygiene seat for a handicapped person, comprising:

a substantially annular seat member with an underside and capable of supporting a person in a seated position, said seat member being capable of resting on at least one side wall of a bathtub for supporting the person in the seated position;

two cooperating tubes being fixed at the underside of said seat member with one of said cooperating tubes being retained at opposing sides of said seat member, said cooperating tubes being adjustable relative to one another in an axial direction and having a detent mechanism for fixing said cooperating tubes in position;

a pair of guide rails affixed to the underside of said seat member and each at a respective one of said opposing sides, said guide rails retaining said one cooperating tube of said two cooperating tubes in position along a length of said one cooperating tube, said guide rails further including two horizontally-opposed indentations;

a board, said board tub being slidably removable from, and held at its edges by, the two horizontally-opposed indentations of said guide rails in a horizontal direction; and, cushion resting on said board.

6. The hygiene seat for a handicapped person according to claim 5, wherein said cooperating tubes are telescopically adjustable relative to one another.

7. The hygiene seat for a handicapped person according to claim 5, wherein said seat member is upholstered.

8. A hygiene seat for a handicapped person, comprising:

a substantially annular seat member with an underside and capable of supporting a person in a seated position, said seat member being capable of resting on at least one side wall of a bathtub for supporting the person in the seated position;

two cooperating tubes being fixed at the underside of said seat member with one of said cooperating tubes being retained at opposing sides of said seat member, said cooperating tubes being adjustable relative to one another in an axial direction and having a detent mechanism for fixing said cooperating tubes in position;

a pair of guide rails affixed to the underside of said seat member and each at a respective one of said opposing sides, said guide rails retaining said one cooperating tube of said two cooperating tubes in position along a length of said one cooperating tube, said guide rails further including two horizontally-opposed indentations; and, a washing tub;

a board and a cushion;

said washing tub and said board each being slidably removable from, and held at its edges by, the two horizontally-opposed indentations of said guide rails in a horizontal direction, said washing tub being capable of use when said board is not being used and said board being capable of use when said washing tube is not being used with said cushion resting on said board.

9. The hygiene seat for a handicapped person according to claim 8, wherein said cooperating tubes are telescopically adjustable relative to one another.

10. The hygiene seat for a handicapped person according to claim 8, wherein said seat member is upholstered.

* * * * *